United States Patent [19]

Jowitt et al.

[11] Patent Number: 4,915,210

[45] Date of Patent: Apr. 10, 1990

[54] POSITIONING A CAN ON A ROTATING TURRET

[75] Inventors: Frederick W. Jowitt; Robert H. Harrison; Keith West; Kevin J. Pope, all of Oxfordshire, United Kingdom

[73] Assignee: CMB Packaging (UK) Limited, Reading, United Kingdom

[21] Appl. No.: 193,451

[22] PCT Filed: Jun. 26, 1987

[86] PCT No.: PCT/GB87/00453

§ 371 Date: May 6, 1988

§ 102(e) Date: May 6, 1988

[87] PCT Pub. No.: WO88/00254

PCT Pub. Date: Jan. 14, 1988

[30] Foreign Application Priority Data

Jul. 7, 1986 [GB] United Kingdom ..... 8616514

[51] Int. Cl.[4] ..... B65G 29/00

[52] U.S. Cl. ..... 198/476.1; 198/480.1; 198/500; 198/477.1

[58] Field of Search ..... 198/474.1, 476.1, 477.1, 198/480.1, 491.1, 723, 500

[56] References Cited

U.S. PATENT DOCUMENTS 2,423,441 7/1947 Dennie ..... 198/481.1

4,059,186 11/1977 Aschberger et al. ..... 198/476.1

*Primary Examiner*—Joseph E. Valenza

*Attorney, Agent, or Firm*—Diller, Ramik & Wight

[57] ABSTRACT

In a high speed apparatus having a rotating turntable, an infeed device has a rotatable turret from which radiate a plurality of can holders which act to transfer cans from an infeed conveyor along an encircling guide rail to the rotating table. A cam element enclosed in the turret may cyclically retract each holder to cause the can to follow the periphery of the rotating turntable.

9 Claims, 3 Drawing Sheets

POSITIONING A CAN ON A ROTATING TURRET

TECHNICAL FIELD

This invention relates to a transfer apparatus for positioning a can in a desired position on a rotating table or turret so as to permit the insertion of a closely fitting mandrel into the can as the table continues its rotation.

BACKGROUND ART

In the can handling art it is frequently necessary to remove individual cans one at a time from a conveyor delivering a row of like cans, and to place each can at a precise location in the periphery of a rotating turret. In known machines used to seam a can end to a can body, a long screw is used to receive each can in its screw thread, and by virtue of the screw thread profile to present each can to a recess in the periphery of a rotating star wheel. The star wheel is rotated so that each can in turn is presented to a work station at the rotating turret.

A geometrical limitation of such an arrangement arises from the necessity for the arc of rotation of the star wheel to coincide with the arc of rotation of the turret, so as to allow a can to be safely and stably deposited from the rotating star wheel on to the rotating turret. Such a coincidence is at best an instantaneous coincidence of two touching arcs, or at worst an overlapping mismatch of two intersecting arcs. Neither such an instantaneous coincidence, nor such a mismatching, of the two arcs permits the satisfactory insertion of a closely fitting mandrel into a can as it is delivered by the star wheel on to the turret as both continue their respective rotations.

The present invention seeks to provide a transfer arrangement for delivering cans from a rotating star wheel to a rotating turret in such a way that a closely fitting mandrel can be safely inserted, at least partly, into a can during its transfer from the rotating star wheel to the rotating turret.

U.S. Pat. No. 4,059,186 (Aschberger) has a similar objective, and provides in an infeed transfer apparatus for transferring articles to a rotating table for cooperation there with successive, circumferentially-spaced article treatment means carried on said table:

(a) a turret member mounted for rotation about a fixed axis parallel with an axis of rotation of the rotating table;

(b) a plurality of article holders extending radially from the turret member at positions spaced around the periphery thereof and arranged for movement toward and away from said fixed axis;

(c) holder operating means comprising (i) a stationary annular cam disposed concentrically about said fixed axis, and (ii) for each such holder, a cam follower coupled to the holder, and a spring biasing means adapted to bias the holder into contact with said cam; and (d) an article guide rail extending around a part of said turret member and spaced radially therefrom, said guide rail having a first arcuate part which is concentric with the turret, and a second arcuate part which is continuous with said first part and which is concentric with said rotating table.

DISCLOSURE OF THE INVENTION

According to the present invention such a transfer apparatus is characterised in that:

(i) said turret member comprises a transverse wall, and an annular side wall extending from the periphery of said transverse wall;

(ii) said cam is disposed radially within said side wall;

(iii) a plurality of circumferentially-spaced radial shafts are slidably mounted in said side wall for reciprocatory sliding movement toward and away from said guide rail, each said radial shaft carrying outside said side wall one said article holder and inside said side wall one said cam follower; and (iv) said spring biasing means are carried within said side wall and are arranged to urge the respective cam followers radially outwards against said cam.

In one preferred arrangement, a turret driving shaft is coupled to and depends centrally from said transverse wall, and said side wall depends from the periphery of said transverse wall.

Preferably, the apparatus also includes a stationary transverse wall having a central aperture through which said driving shaft extends, which wall is adapted to enclose and protect said cam, cam followers and biasing spring means from a damaging external wet environment.

Inner and outer annular side walls may be upstanding from inner and outer peripheries of said stationary transverse wall thereby to form a reservoir for receiving a lubricating oil, and distributor means may be adapted to distribute such oil from said reservoir to moving parts disposed within a space enclosed by the respective moving and stationary transverse and annular side walls.

The distributor means may include a cylindrical, oil pumping sleeve fitting closely around said stationary, inner annular side wall and drivingly coupled for movement with the moving transverse wall of the turret, which sleeve has formed in its inner surface a spiral pumping groove.

Preferably, each said radial shaft is slidably mounted in a withdrawable bearing unit, which bearing unit is demountably carried in said turret side wall in a manner such as to permit it and its associated radial shaft and cam follower to be withdrawn as a single operating unit radially outwards from said side wall.

Each said withdrawable bearing unit may also incorporate the associated spring biasing means.

In a preferred embodiment, said annular cam is disposed below said radial shafts; each such radial shaft carries a dependent stub shaft; and each said stub shaft carries a rotatable roller which constitutes the associated cam follower.

Other features of the present invention will appear from a reading of the description that follows hereafter and of the claims appended at the end of that description.

One transfer apparatus according to the present invention, as incorporated in an electro-coating apparatus, and its method of operation, and various modifications of such transfer apparatus, will now be described by way of example and with reference to the accompanying diagrammatic drawings.

BRIEF DESCRIPTION OF THE DRAWINGS

In those drawings.

BEST MODES OF CARRYING OUT THE INVENTION

In the description that follows hereafter, an asterisk shown in association with a reference number indicates a first mention of that reference number.

Figure 1:
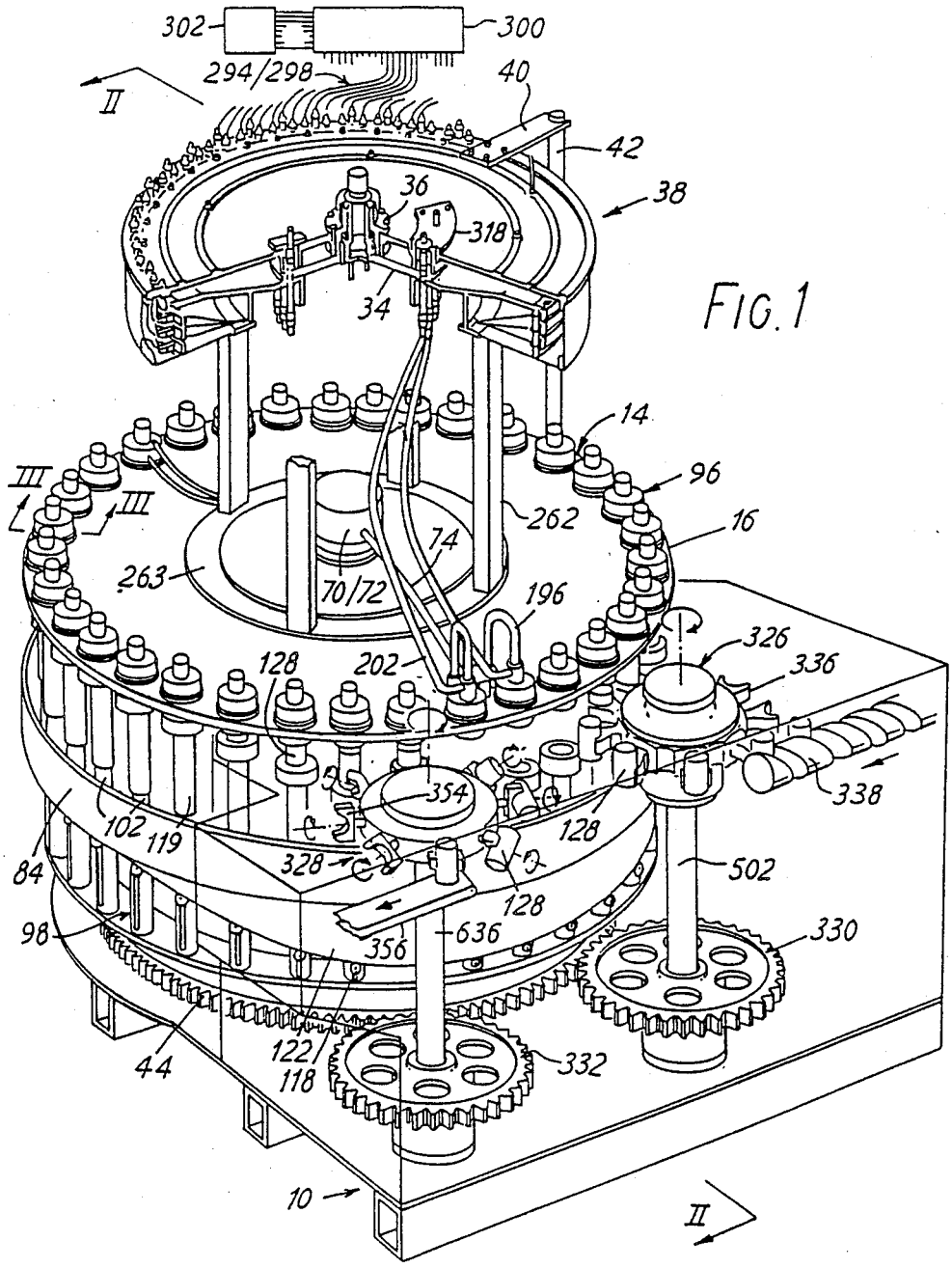
-FIG. 1 shows a pictorial representation of the electro-coating apparatus and the associated infeed transfer apparatus for feeding cans which are to be electro-coated.
Figure 2:
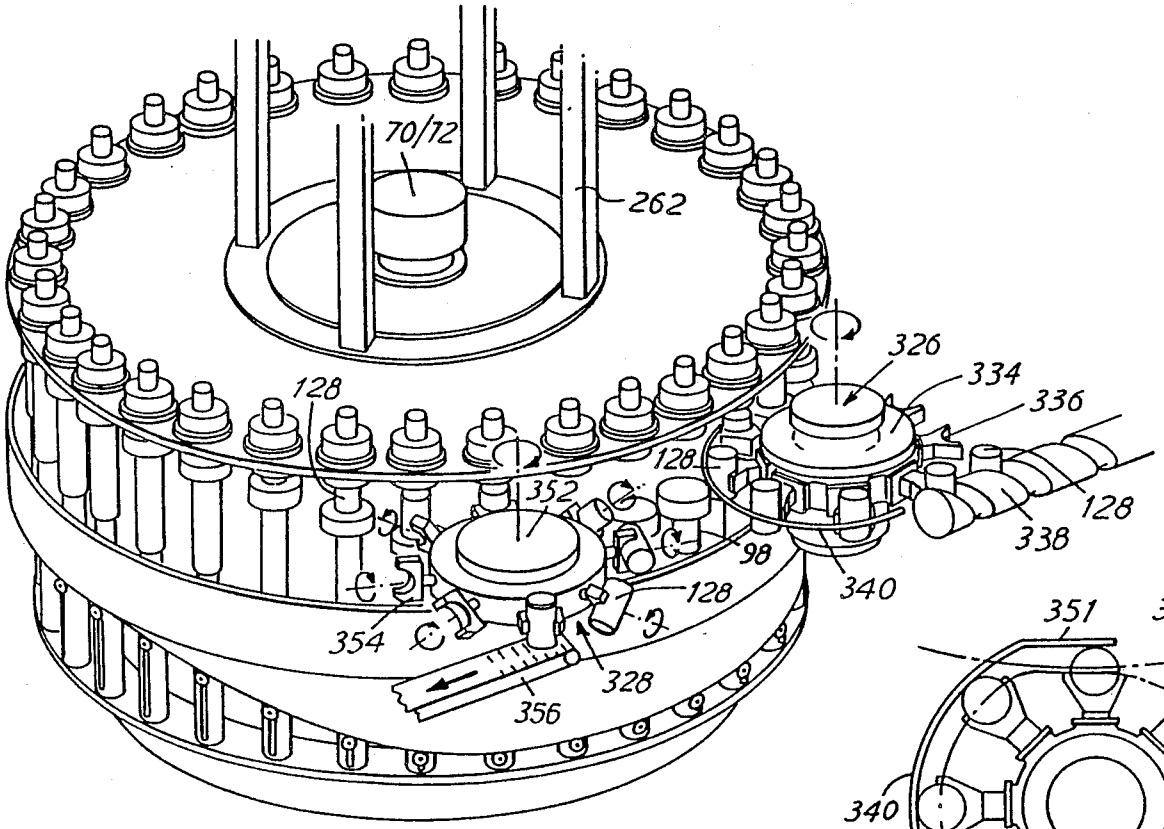
FIG. 2 shows diagrammatically an enlargement of a lower part of the FIG. 1.
Figure 3:
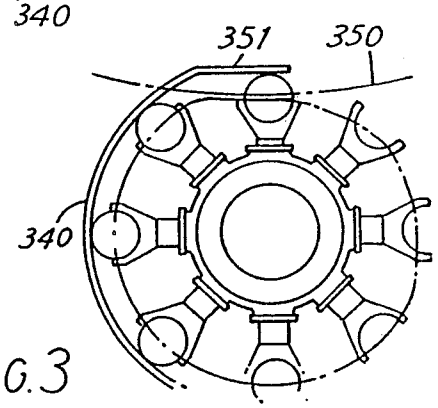
FIG. 3 shows a plan view of the infeed device.

Referring now to the drawings, FIG. 1 shows an electro-coating apparatus for electro-coating metal can bodies 128* (referred to hereafter simply as 'cans') of the kind having a cylindrical side wall extending integrally from a base wall. For a full description of the apparatus, the reader's attention is hereby directed to the co-pending U.S. patent applications which are listed at the end of this description.

Briefly, however, the electro-coating apparatus comprises a turntable 14* having mounted in an upper plate 16* thereof a series of spaced electro-coating cell bodies 96* into which respective upright cans 128 are to be introduced from below, and then be enclosed by, respective pneumatically operated cell closers 100*, for the performance of the electro-coating process. Each electro-coating cell body 96 incorporates a system of concentric electrodes between which the side wall of the can is to be accurately and concentrically positioned for electro-coating.

Cans 128, delivered spaced apart by a screw conveyor 338*, are transferred to the electro-coating apparatus by an infeed transfer device 326*. That device comprises a rotary turret 334* from which a series of spaced can holders or pockets 336* radiate. Those holders are arranged to drive the respective cans along a circular locus in contact with a first arcuate part of a fixed guide rail 340* of the infeed device, and to deliver the respective cans in turn to the respective cell closers 100, at a predetermined infeed station, as they continue at constant speed along their circular locus 350 with continuing rotation of the turntable 14.

In order to ensure a stable deposit of each can 128 on its respective cell closer 100, the guide rail 340 has a second arcuate part 351 conforming to the locus 350 of the moving cell bodies 96 on the turntable. The can holders 336 acting in cooperation with this second part of the guide rail are arranged to bring each can in turn into the circular locus 350 of the associated moving cell body 96, and then to move the can along that circular locus 350 whilst the cell closer 100 is brought up from below into contact with the can 128.

Each can holder 336 thereafter returns to its normal circular locus in readiness for receiving its next can from the screw conveyor 338.

Figure 4:
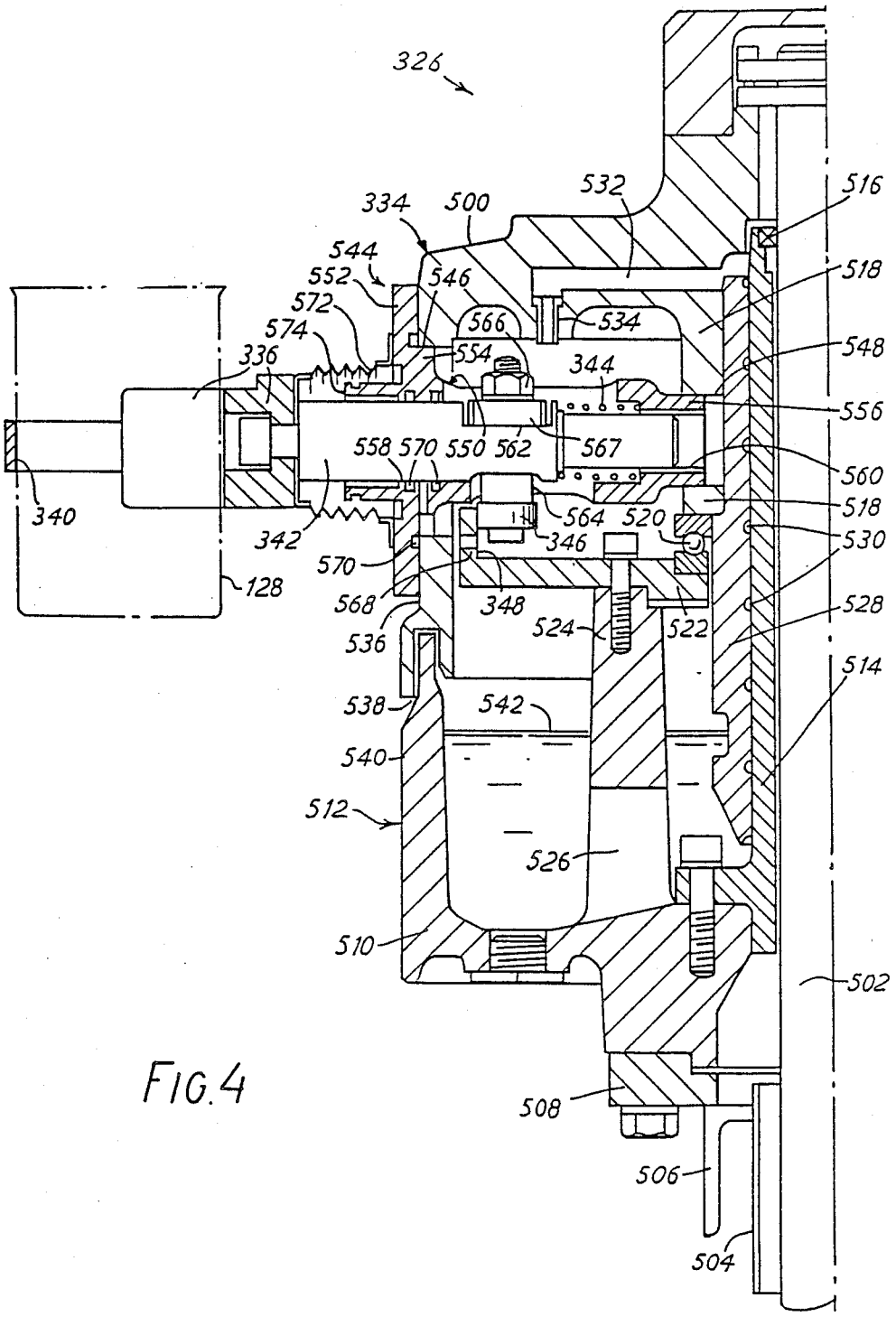
FIG. 4 shows in a vertical cross section the construction and mode of operation of the infeed device, which cross section is taken on a diametral plane of the infeed device.

As shown in the FIG. 4, each can holder 336 is carried within the turret 334 on a retractable shaft 342* which is biased by an helical compression spring 344* to an outer can-guiding position. That shaft has, within the turret, a cam follower wheel 346* which is urged by the action of that biasing spring radially outwards against the shaped internal surface of a static, generally circular cam 348*. That cam surface is shaped so as when the can holder moves into the position for depositing a can 128 on the cell closer 100 then at the infeed station, it is gradually and temporarily retracted slightly so as to enable the can holder to follow for a short way the locus 350 of the cell closer 100 as it moves into, through and beyond the infeed station. This enables the can to be properly transferred to and positioned on the cell closer, since the can holder and cell closer move for a short way along the same locus. The guide rail 340 is shaped as shown at 351 so as to cause the can to move into and along that locus 350.

In more detail, the infeed turret 334 comprises an inverted cup-shaped member 500* secured at the top of a driving shaft 502* which rises, through a tubular shroud 504*, from a torque-limiting device (not shown) which is connected to the gear wheel 330*. That shroud passes upwardly through a transverse support channel 506* which carries on its upper surface a fixed, turret-location socket 508*. Secured in that socket is a turret support means 510* which incorporates a lubricating oil reservoir tank 512*. An upstanding tubular member 514* constituting an inner wall of that oil tank encloses the driving shaft 502 which extends therethrough with clearance. A seal 516* provided at the upper end of that tubular member 514 prevents the exit of lubricating oil between that member and the driving shaft.

The turret incorporates a dependent, inner cylindrical wall 518* of which the lower end is rotatably supported on a ball bearing race 520* which is itself carried on a transverse platform 522*. That platform is secured by screws on an upstanding intermediate cylindrical wall 524* which rises out of the oil tank and which has in its lower part an aperture 526* to allow circulation of the lubricating oil within the tank.

An oil pumping sleeve 528* encircles the upstanding tubular member 514, is secured at its upper end in the inner dependent wall 518 of the turret, and has formed in its bore a spiral, oil-pumping groove 530*. Thus, on rotation of the turret, oil from the reservoir rises up the spiral groove and is delivered at the upper end of the sleeve 528 into a plurality of radial, distribution ducts 532* from where it escapes via vertical nozzles 534* into the spaces enclosed below.

The lower rim of the outer cylindrical wall 536* of the turret has an annular groove 538* into which extends the thin upper rim of the outer cylindrical wall 540* of the oil reservoir tank 512, in such manner as to prevent the ingress of electro-coating fluid into the reservoir tank. The lubricating oil surface level indicated at 542* is maintained at a height such as to prevent the loss of oil between the tongue-and-groove junction of the outer walls of the turret and oil tank.

The turret has secured around its circumference at each of eight equi-spaced positions a respective can holder unit 544*, which is removably carried within radially-aligned, large and small apertures 546*, 548* formed respectively in the outer and inner cylindrical walls 536 and 518 of the turret.

Each can holder unit comprises a slotted body 550* which is provided at one end with a fixing flange 552* and an adjacent spigot portion 554* for locating and securing (by screws not shown) the unit in position in the aperture 546, and at the other end with a plug portion 556* which locates in said smaller aperture 548.

The retractable shaft 342 supports at its outer end the associated can holder 336, is slidably carried in respective radially-aligned bores 558*, 560* formed in the respective end portions of the slotted body 550, and has a central waisted portion 562* in which is carried a vertical stub shaft 564*. That stub shaft is secured in position by a nut 566* which engages the slotted body via a slide block 567* carried in a slide way formed in the slotted body, and carries rotatably mounted at its lower end the said cam follower wheel 346. The biasing spring 344 is trapped on the retractable shaft 342 between shoulders formed on that shaft and in the slotted body.

The transverse platform 522 has at its outer periphery an upstanding wall 568*, of which the inwardly facing surface constitutes the said circular cam 348.

Sealing rings 570* are provided on the retractable shaft, and behind the fixing flange 552, to prevent the ingress of electro-coating fluid into the turret, and also to prevent the egress of lubrication oil. Annular shrouds in the form of flexible bellows 572* are provided on the retractable shaft 342 and the fixing flange 552, and a tubular extension 574* is provided on that flange, all for that same purpose.

The reader's attention is hereby directed to the following concurrently-filed, co-pending U.S. patent applications which claim other aspects of the electro-coating apparatus referred to above: namely—Ser. Nos. 07/193,452; 07/193,454; and 07/193,455, all filed May 6, 1988.

What is claimed is:

1. Transfer apparatus for transferring articles to a rotating table for cooperation there with successive, circumferentially-spaced article treatment means carried on said table comprising:

(a) a turret member mounted for rotation about a fixed axis parallel with an axis of rotation of the rotating table;

(b) a plurality of article holders extending radially from the turret member at positions spaced around the periphery thereof and arranged for movement toward and away from said fixed axis;

(c) holder operating means including a stationary annular cam disposed generally concentrically about said fixed axis, and for each such holder, a cam follower coupled to the holder and spring biasing means adapted to bias each holder into contact with said stationary cam;

(d) an article guide rail extending around a part of said turret member and spaced radially therefrom, said guide rail having a first arcuate part which is generally concentric with the turret, and a second arcuate part which is continuous with said first part and which is generally concentric with said rotating table;

characterized in that:

(i) said turret member comprises a transverse wall, and an annular side wall extending from the periphery of said transverse wall;

(ii) said cam is disposed radially within said side wall;

(iii) a plurality of circumferentially-spaced radial shafts are slidably mounted in said side wall for reciprocatory sliding movement toward and away from said guide rail, each said radial shaft carrying outside said side wall one said article holder and inside said side wall one said cam follower; and (iv) said spring biasing means are carried within said side wall and are arranged to urge the respective cam followers radially outwards against said cam.

2. Transfer apparatus according to claim 1, wherein a turret driving shaft is coupled to and depends centrally from said transverse wall, and said side wall depends from the periphery of said transverse wall.

3. Transfer apparatus according to claim 2, including a stationary transverse wall having a central aperture through which said driving shaft extends, which wall is adapted to enclose and protect said cam, cam followers and biasing spring means from a damaging external wet environment.

4. Transfer apparatus according to claim 3, including inner and outer annular side walls upstanding from inner and outer peripheries of said stationary transverse wall thereby to form a reservoir for receiving a lubricating oil, and distributor means adapted to distribute such oil from said reservoir to moving parts disposed within a space enclosed by the respective moving and stationary transverse and annular side walls.

5. Transfer apparatus according to claim 4, wherein said distributor means includes a cylindrical, oil pumping sleeve fitting closely around said stationary, inner annular side wall and drivingly coupled for movement with the moving transverse wall of the turret, which sleeve has formed in its inner surface a spiral pumping groove.

6. Transfer apparatus according to claim 1, wherein each said radial shaft is slidably mounted in a withdrawable bearing unit, which bearing unit is demountably carried in said turret side wall in a manner such as to permit it and its associated radial shaft and cam follower to be withdrawn as a single operating unit radially outwards from said side wall.

7. Transfer apparatus according to claim 6, wherein each said withdrawable bearing unit incorporates the associated spring biased means.

8. Transfer apparatus according to claim 6, wherein said annular cam is disposed below said radial shafts; each such radial shaft carries a dependent stub shaft; and each said stub shaft carries a rotatable roller which constitutes the associated cam follower.

9. Transfer apparatus according to claim 7, wherein said annular cam is disposed below said radial shafts; each such rotatable shaft carries a dependent stub shaft; and each said stub shaft carries a rotatable roller which constitutes the associated cam follower.

* * * * *